United States Patent [19]

Unmuth et al.

[11] Patent Number: 4,728,415

[45] **Date of Patent: * Mar. 1, 1988**

[54] PROCESS FOR THE MANUFACTURE OF LUBRICATING OILS

[75] Inventors: Eugene E. Unmuth; Ralph J. Bertolacini, both of Naperville; John A. Mahoney, Glen Ellyn, all of Ill.

[73] Assignee: Amoco Corporation, Chicago, Ill.

[ * ] Notice: The portion of the term of this patent subsequent to Jan. 13, 2004 has been disclaimed.

[21] Appl. No.: 945,084

[22] Filed: Dec. 22, 1986

Related U.S. Application Data

[63] Continuation-in-part of Ser. No. 686,096, Dec. 24, 1984.

[51] Int. Cl.[4] ..... C10G 67/04

[52] U.S. Cl. ..... 208/87; 208/18; 208/89; 208/111; 208/114; 208/211; 208/212

[58] Field of Search ..... 208/87, 89, 18, 110, 208/111, 211, 212, 114

[56] References Cited

U.S. PATENT DOCUMENTS

| | | | |
|---|---|---|---|
| 3,403,092 | 9/1968 | Rausch | 208/87 |
| 3,929,616 | 12/1975 | Mead et al. | 208/87 |
| 4,229,282 | 10/1980 | Peters et al. | 208/111 |
| 4,434,047 | 2/1984 | Hensley, Jr. et al. | 208/111 |
| 4,437,975 | 3/1984 | Gillespie et al. | 208/18 |
| 4,515,680 | 5/1985 | Hettinger et al. | 208/89 |
| 4,560,469 | 12/1985 | Hopkins et al. | 208/110 |
| 4,563,266 | 1/1986 | Hopkins et al. | 208/111 |
| 4,636,299 | 1/1987 | Unmuth et al. | 208/89 |

*Primary Examiner*—Helen M. S. Sneed
*Assistant Examiner*—Anthony McFarlane
*Attorney, Agent, or Firm*—Ekkehard Schoettle; William H. Magidson; Ralph C. Medhurst

[57] ABSTRACT

The present invention provides for a process for reducing the pour point of a hydrocarbon feedstock containing nitrogen- and sulfur-containing impurities. The hydrocarbon feedstock is contacted with hydrogen and a hydrotreating catalyst under hydrotreating conditions whereby a portion of the nitrogen- and sulfur-containing compounds are converted to hydrogen sulfide and ammonia. A portion of the hydrotreater effluent is then passed to a dewaxing zone and contacted with hydrogen under dewaxing conditions in the presence of a dewaxing catalyst containing a borosilicate molecular sieve on silica-alumina-containing matrix.

25 Claims, 1 Drawing Figure

SELECTIVITY FOR SAE40 DISTILLATE DEWAXING USING HAMS/SILICA-ALUMINA
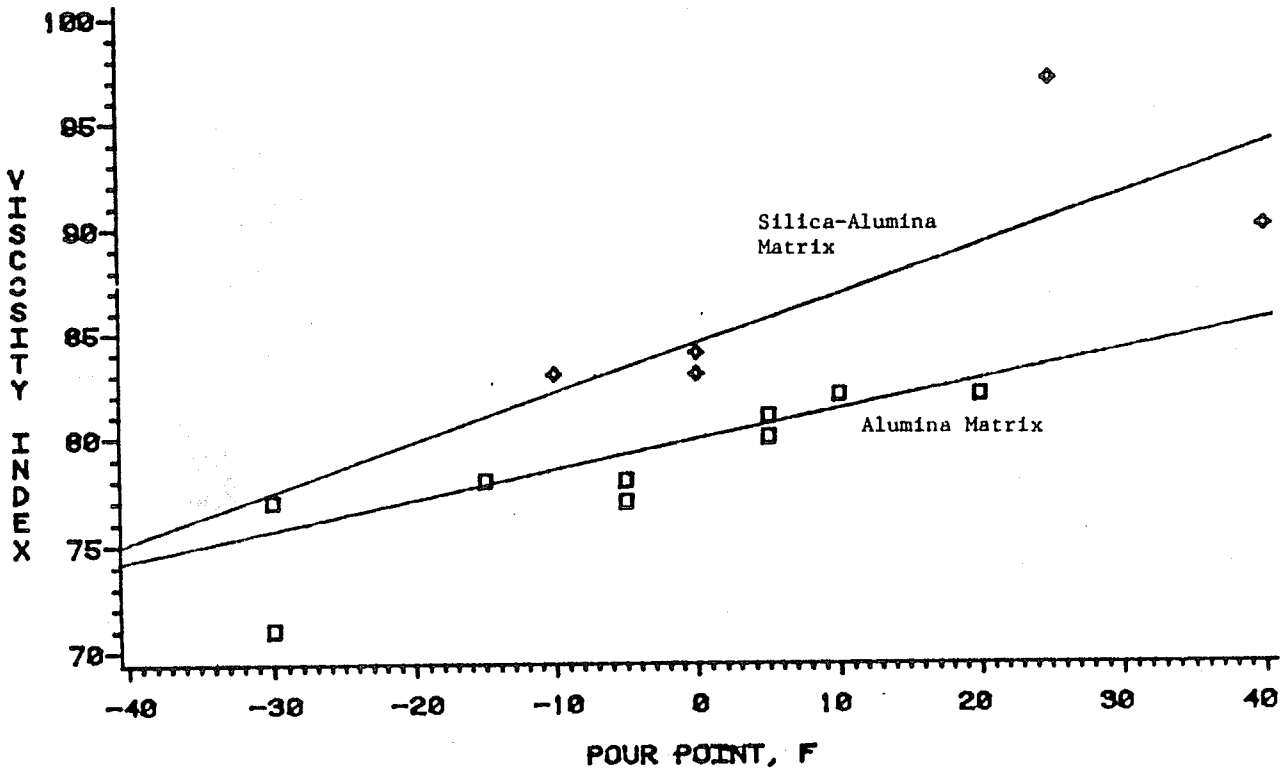

PROCESS FOR THE MANUFACTURE OF LUBRICATING OILS

CROSS-REFERENCE TO RELATED APPLICATIONS

This application is a continuation-in-part application of co-pending U.S. Ser. No. 686,096 which was filed on Dec. 24, 1984.

BACKGROUND OF THE INVENTION

This invention relates to a process for dewaxing petroleum oils and fractions thereof by selectively removing normal paraffinic and other undesirable hydrocarbons from petroleum oils in which they are present in admixture with other hydrocarbons, in order to lower the pour point of such oils. More specifically, the present invention relates to a particular combination and sequence of catalytic unit processes whereby a lube oil is produced having a low pour point and a high viscosity index.

In the preparation of lube oils from hydrocarbon feeds, catalytic dewaxing processes are often combined with hydrotreating, hydrocracking and/or various solvent extraction steps to obtain products having desired properties. Typically, hydrocracking and/or solvent extraction steps are conducted prior to catalytic dewaxing to remove components such as metal-containing feed components, asphaltenes and polycyclic aromatics having properties that differ grossly from those desired. In particular, solvent extraction is conducted to remove polycyclic aromatic feed components and nitrogen-containing cyclic components, removal of the latter being particularly important in order to avoid poisoning of catalyst in catalytic dewaxing. Hydrotreating under mild or severe conditions typically follows catalytic dewaxing operations and serves to improve oxidation stability and reduce the nitrogen and sulfur content of the lube oil.

As one example of a process for producing lube oils in which a catalytic dewaxing step is included as part of a multistep process, U.S. Pat. No. 4,259,170 (Graham et al.) discloses a process that includes a combination of catalytic dewaxing and solvent dewaxing steps. According to a more specific aspect of Graham et al., the process includes a solvent extraction step prior to a dewaxing step where any suitable solvent may be used such as furfural, phenol, chlorex, nitrobenzene, or N-methyl-pyrrolidone. As a further example of a multistep process for preparation of lube oils, U.S. Pat. No. 4,259,174 (Chen et al.) discloses a process comprising solvent extraction followed by catalytic dewaxing.

U.S. Pat. No. 4,283,272 (Garwood et al.) discloses preparation of lube oils by a process that includes hydrocracking, catalytic dewaxing and hydrotreating steps.

U.S. Pat. No. 4,292,166 (Gorring et al.) discloses a combination process wherein a dewaxing step is carried out prior to a hydrocracking step. Specifically, a hydrocarbon oil feed selected from the group consisting of vacuum gas oils, deasphalted oils and mixtures thereof is converted to a low pour point, high VI lube base stock by first dewaxing the feed in the presence of hydrogen and a dewaxing catalyst comprising a zeolite having a Constraint Index of 1 to 12 followed by contacting the dewaxed feedstock and hydrogen with a hydroconversion catalyst comprising a platinum group metal and a zeolite having a silica to alumina ratio of at least 6.

Gorring et al. also contemplates interposing a conventional hydrotreating step between catalytic dewaxing and the hydrocracking step where the feed to the process contains high levels of deleterious nitrogen compounds.

A combination process is also disclosed in U.S. Pat. No. 4,358,363 (Smith) wherein a fuel oil, containing impurities deleterious to the catalyst is first treated with a sorbent comprising a first molecular sieve zeolite having pores with an effective diameter of at least about 5 Angstroms under sorption conditions followed by a treatment with a dewaxing catalyst comprising a second molecular sieve zeolite having pores with an effective diameter of at least about 5 Angstroms and equal to or smaller than the effective diameter of the pores of the first molecular sieve zeolite. In a more specific aspect of the disclosure, the first and second molecular sieves have the same crystal structure wherein the Constraint Index is 1 to 12 and the dried hydrogen form crystal density is less than about 1.6 grams per cubic centimeter.

The Patentee indicates that the effectiveness of the dewaxing catalyst is increased when catalyst poisons speculated to be basic nitrogen compounds and oxygen and sulfur compounds are removed. The teachings of U.S. Pat. No. 4,282,085 (O'Rear et al.) likewise appreciate the deleterious effect of nitrogen-containing impurities on ZSM-5-type crystalline aluminosilicate containing catalysts. Specifically, patentees disclose a process for upgrading a petroleum distillate feed with a catalyst comprising ZSM-5-type zeolite possessing no hydrogenation activity wherein the feed has a content of nitrogen-containing impurities, calculated by weight as nitrogen below about 5 ppm. The low-nitrogen feedstock results in a lower deactivation rate for the catalyst.

U.S. Pat. No. 4,153,540 (Gorring et al.) discloses a process for upgrading full range shale oil. More specifically, Patentee's process involves contacting the full range shale oil with a hydrotreating catalyst and hydrogen in order to convert organic compounds of sulfur, nitrogen, oxygen, and metal. The effluent from the hydrotreater is then passed to a dewaxing zone and contacted with dewaxing catalyst at conversion conditions calculated to hydrodewax the shale oil and convert at least 50% of the shale oil boiling above about 750° F. to reaction products boiling below 750° F.

Of the various solvent extraction processes, the most prevalent solvent employed is phenol. Other solvents employed include low boiling point autorefrigerative hydrocarbons, such as propane, propylene, butane, pentane, etc., liquid sulfur dioxide, furfural, and N-methyl-2-pyrrolidone (NMP). NMP is a preferred solvent because it is less toxic in relation to the above-mentioned solvents and requires less energy to effect the extraction.

Generally, when the solvent-extracted raffinate base stocks are dewaxed with a shape selective zeolite, the viscosity index of the product oil is reduced to a greater extent than if the same stock were solvent dewaxed. This is because shape selective dewaxing catalysts reduce pour point by normal and near normal paraffin cracking which results in a concentration of low VI possessing aromatics in the product oil. Some shape selective molecular sieves are more selective than others in VI retention during dewaxing because their selectivity for normal paraffin cracking versus isoparaffin cracking is high which results in the retention of high VI isoparaffins in the oil. For instance, even though the borosilicate molecular sieve as disclosed in U.S. Pat. No. 4,269,813 (Klotz) falls in the category of high VI selective catalysts, the VI loss relative to solvent dewaxing is in the range of 8-12 VI units for phenol-extracted SAE 10 raffinate. This loss would have to be compensated for by more severe solvent extraction of aromatics which is expensive and energy consuming The loss in VI attributed to catalytic hydrodewaxing in comparison to solvent dewaxing is also noted in a paper entitled "Hydrodewaxing of Fuels and Lubricants using ZSM-5 type Catalysts," by R. G. Graven and J. R. Green presented at the Australian Institute of Petroleum 1980 Congress. Therein it is mentioned that the VI for neutral distillate charge stocks dewaxed in the presence of a ZSM-5 catalyst is lower by 3 to 8 units than comparable quality solvent dewaxed neutrals.

In a paper presented at the 1983 NPRA annual meeting entitled "Low-Temperature Performance Advantages for Hydrodewaxed Base Stocks and Products," by C. N. Rowe, and J. A. Murphy, there is also pointed out that the VI differential between the catalytic dewaxing process disclosed therein and conventional solvent dewaxing ranges between 6 to 10 units for light neutrals feedstocks to little or no difference for bright feedstocks.

We have observed that not all solvent raffinates can be subsequently catalytically dewaxed on an equivalent basis. In particular, the high nitrogen content levels, particularly basic nitrogen compounds, in certain solvent-extracted raffinates are believed to be responsible for the rapid deactivation of the dewaxing catalyst.

For instance, we have found NMP-extracted raffinates to be substantially more difficult to dewax over a shape-selective dewaxing catalyst, i.e., greater deactivation rate than phenol-extracted raffinates.

Thus, the prior art combination dewaxing systems and teachings can be summarized as follows. Hydrotreating is typically carried out subsequent to the catalytic dewaxing step to improve color, color stability, and hydrogenate olefins. The deleterious effect of nitrogen on aluminosilicate-containing catalytic dewaxing catalysts is known, especially when a high nitrogen content shale oil is upgraded in a hydrowaxing zone wherein at least 50% conversion occurs. The art is silent with respect to recognition of the detrimental effect of NMP extraction carried out prior to dewaxing on dewaxing catalyst activity, as the art considers the various solvents to be equivalent aside from disparate cost and toxicity. The art is also silent with respect to the VI improvement achievement in a catalytic dewaxing zone when the influent thereto is hydrotreated. Finally, the art is silent with respect to the additional improvement in VI afforded by the use of silica-alumina as a matrix material in the dewaxing catalyst when contrasted with the use of pure alumina as the matrix material.

The process of the present invention obviates the rapid deactivation phenomenon described above while simultaneously, surprisingly, increasing the viscosity index (VI) and reducing the pour point of the lube stock.

Accordingly, it is an object of the present invention to provide a process which obviates the VI debit associated with catalytic dewaxing while simultaneously prolonging the activity of the dewaxing catalyst. These and other objects will become evident to one skilled in the art on reading this entire specification including the appended claims.

BRIEF SUMMARY OF THE INVENTION

The process of the present invention relates to a process for reducing the pour point of a hydrocarbon feedstock containing nitrogen and sulfur-containing compounds which process involves initially passing the hydrocarbon feedstock to a hydrotreating zone wherein hydrogen is contacted with the hydrocarbon feedstock in the presence of a hydrotreating catalyst at hydrotreating conditions wherein a substantial portion of the nitrogen and sulfur containing compounds are converted to hydrogen sulfide and ammonia.

At least a portion of the effluent from the hydrotreating zone is then passed to a stripping zone wherein hydrogen sulfide and ammonia are removed to form a stripping zone effluent.

At least a portion of the stripping zone effluent is then passed to a dewaxing zone wherein hydrogen is contacted with stripping zone effluent at catalytic dewaxing conditions in the presence of a catalyst composition comprising a borosilicate molecular sieve and at least one hydrogenation component selected from the group consisting of Group VIB and Group VIII metals; wherein the catalyst further contains a matrix comprising silica-alumina wherein the alumina is present in an amount ranging from about 5 to about 50 wt. % based on the total amount of silica-alumina present.

The process of the invention serves to reduce the pour point of the hydrocarbon feedstock and increase the feedstock's VI.

In another embodiment of the present invention, the hydrocarbon feedstock is solvent extracted with a solvent to remove a portion of the aromatic compounds contained therein to form an extraction zone effluent, at least a portion of which is passed to the hydrotreating zone.

In a preferred embodiment, the above extraction step is carried out with NMP. Failure to hydrotreat subsequent to NMP extraction leads to premature poisoning, i.e., poor stability of the borosilicate sieve.

BRIEF DESCRIPTION OF THE DRAWING

The accompanying FIGURE plots VI versus pour point as achieved by the process of the invention contrasted with a comparative process.

DETAILED DESCRIPTION OF THE INVENTION

Briefly, the present invention comprises a process for reducing the pour point of a hydrocarbon feedstock containing nitrogen and sulfur-containing compounds which process comprises passing the hydrocarbon feedstock to hydrotreating zone wherein hydrogen is contacted with the hydrocarbon feedstock in the presence of a hydrotreating catalyst at hydrotreating conditions wherein a substantial portion of the nitrogen and sulfur-containing compounds are converted to hydrogen sulfide and ammonia.

At least a portion of the effluent from the hydrotreating zone is then passed to a stripping zone where hydrogen sulfide and ammonia are removed from the hydrotreating zone effluent to form a stripping zone effluent.

At least a portion of the stripping zone effluent is then passed to a dewaxing zone wherein hydrogen is contacted with the stripping zone effluent at catalytic dewaxing conditions in the presence of a catalyst composition comprising a borosilicate molecular sieve and at least one hydrogenation component selected from the group consisting of Group VIB and Group VIII metals; wherein the catalyst further contains a matrix comprising silicaalumina wherein the alumina is present in an amount ranging from about 5 to about 50 wt. % based on the total amount of silica-alumina present.

Without wishing to be bound by theory, it is believed that the nitrogen removal to very low levels effected in the hydrotreating stage results in higher dewaxing activity because the acid sites in the shape selective molecular sieve component of the dewaxing catalyst are not poisoned by basic nitrogen compounds or ammonia. Further, it is believed that because the sulfur level is also reduced to very low levels during the hydrotreating stage, there is a diminished opportunity for the sulfur to poison the hydrogenation component function in the dewaxing catalyst. This results in increased aromatics saturation in the dewaxing zone and, hence, an increase in the VI of the lube base stock. In the prior art processes where the feed to the dewaxing stage was not hydrotreated, the VI of the product tended to decrease because aromatics are unreactive in the presence of a poisoned hydrogenation component and hence are concentrated in the lube oil fraction by the normal paraffin cracking taking place.

The present invention can be carried out with various hydrocarbon feed materials, such as petroleum or synthetic crude oil fractions, which may contain appreciable quantities of aromatics and impurities such as sulfur or nitrogen.

In greater detail, the hydrocarbon feed materials employed according to the present invention are whole petroleum or synthetic crude oils, coal or biomass liquids, or fractions thereof. Narrower fractions include fuel oils, waxy lube oil distillates, waxy lube oil solvent raffinates and lube oil distillates or raffinates which have been previously partially dewaxed by solvent dewaxing, e.g., toluene-methyl ethyl ketone or propane dewaxing.

The process of the present invention provides especially good results when the feed is a lube oil distillate which has not been passed through an extraction zone to effect the removal of aromatics.

The process of the present invention also gives particularly good results with respect to feeds which contain appreciable amounts of sulfur and nitrogen, especially where nitrogen is in the form of basic nitrogen compounds.

In a preferred embodiment of the present invention, the process is employed to treat NMP extracted raffinates. NMP extracted raffinates are not equivalent to other solvent extracted raffinates in that they have been found to rapidly deactivate a dewaxing catalyst. The NMP extracted raffinates have a relatively high basic nitrogen compound content especially when compared with phenol-extracted raffinates. NMP is a preferred solvent by virtue of its low toxicity. The NMP extraction step is carried out in a conventional fashion.

The solvent, or NMP, extraction step is carried out to extract a portion of the aromatics present in the hydrocarbon feed. Optionally the raffinate phase can be processed to remove any entrained and dissolved solvent.

Solvent ratios vary from 0.5 volumes solvent recycled per volume of feed to 5 volumes solvent recycled per volume feed. Extraction is typically carried out in a number of counter-current washing stages. Columns containing perforated plates, bubble caps, and channel trays, similar to those used for distillation operations are often employed. Another typical contacting device is a Shell rotating disc contactor. The subject contactor consists of a vertical vessel fitted with a series of stator rings fixed to the wall together with a central rotating shaft carrying a number of discs, one to each of the compartments formed by the stator rings.

As previously mentioned, the process of the present invention provides particularly good results with respect to VI improvement when waxy lube oil distillates are used as a feed material and no prior aromatics extraction step is carried out. The substantial VI improvement afforded by the use of a silica-alumina matrix in the dewaxing catalyst permits the omission of an aromatics extraction step when a lube oil distillates is the feedstock.

In any event, up to about 2.0 wt. % sulfur, 1.5 wt. % oxygen and 1.5 wt% nitrogen can be present in the feed stream to the hydrotreater without adversely affecting the process of the invention. Good results are achieved with feeds containing sufficiently high levels of waxy components as to exhibit pour points of at least 30° F. Other suitable feed materials include distillate fractions boiling above about 500° F. and having pour points of about 50° to about 150° F. Both vacuum and atmospheric distillate fractions are contemplated according to the invention as are deasphalted resids.

Suitable operating conditions in the hydrotreating zone are summarized in Table 1.

TABLE 1

HYDROTREATING OPERATING CONDITIONS

| Conditions | Broad Range | Preferred Range |
|---|---|---|
| Temperature, °F. | 400–850 | 500–750 |
| Total pressure, psig | 50–4,000 | 400–1800 |
| LHSV | .10–20 | .25–2.5 |
| Hydrogen rate, SCFB | 500–20,000 | 800–6,000 |
| Hydrogen partial pressure, psig | 50–3,500 | 500–1,000 |

The hydrotreater is also preferably operated at conditions that will result in an effluent stream having less than 10 ppmw nitrogen-containing impurities, based on nitrogen, and less than 20 ppmw sulfur-containing impurities, based on sulfur, and most preferably less than 5 ppmw and 10 ppmw, respectively. The above-set out preferred nitrogen and sulfur contents correspond to substantial conversion of the sulfur and nitrogen compounds entering the hydrotreater.

The catalyst employed in the hydrotreater can be any conventional and commercially available hydrotreating catalyst. The subject hydrotreating catalysts typically contain one or more elements from Groups IIB, VIB, and VIII supported on an inorganic refractory support such as alumina. Catalysts containing NiMo, NiMoP, CoMo, CoMoP, and NiW are most prevalent.

Other suitable hydrotreating catalysts for the hydrotreating stage of the present invention comprise a Group VIB metal component or non-noble metal component of Group VIII and mixtures thereof, such as cobalt, molybdenum, nickel, tungsten and mixtures thereof. Suitable supports include inorganic oxides such as alumina, amorphous silica-alumina, zirconia, magnesia, boria, titania, chromia, beryllia, and mixtures thereof. The support can also contain up to about 20 wt. % zeolite based on total catalyst weight. A preferred hydrotreating catalyst contains sulfides or oxides of Ni and Mo composited with an alumina support wherein the Ni and Mo are present in amounts ranging from 0.1 wt. % to 10 wt. % calculated as NiO and 1 wt. % to 20 wt. % calculated as $MoO_3$ based on total catalyst weight.

Prior to the dewaxing step, the $H_2S$ and $NH_3$ is stripped from the hydrotreater effluent in a conventional manner in a gas-liquid separation zone.

The dewaxing zone contains a catalyst capable of pour point reduction comprising a borosilicate molecular sieve and a hydrogenation component. The sieve material can be dispersed in a matrix of at least one non-zeolitic, porous refractory inorganic oxide matrix component as the use of such a matrix component facilitates.

The hydrogenation component is selected from the group consisting of Group VIB metals and Group VIII metals.

One class of borosilicate molecular sieves useful as the shape selective component of the catalysts employed according to the present invention is the shape selective crystalline borosilicates of the AMS type. Such materials have the following composition in terms of mole ratios of oxides, $$0.9\pm0.2\ M_{2/n}O:B_2O_3:YSiO_2:ZH_2O$$

wherein M is at least one cation having a valence of n, Y ranges from about 4 to about 600 and Z ranges from 0 to about 160, and provide an X-ray diffraction pattern comprising the following X-ray diffraction lines and assigned strengths.

| d(Å) | Assigned Strength |
|---|---|
| 11.2 ± 0.2 | W-VS |
| 10.0 ± 0.2 | W-MS |
| 5.97 ± 0.07 | W-M |
| 3.82 ± 0.05 | VS |
| 3.70 ± 0.05 | MS |
| 3.62 ± 0.05 | M-MS |
| 2.97 ± 0.02 | W-M |
| 1.99 ± 0.02 | VW-M |

Such crystalline borosilicates typically are prepared by reaction of boron oxide and a silicon-containing material in a basic medium. Further details with respect to these shape selective crystalline borosilicate components are found in commonly assigned U.S. Pat. No. 4,269,813 (Klotz), which is incorporated herein by reference, wherein the AMS-1B crystalline borosilicate molecular sieve is disclosed.

AMS-1B crystalline borosilicate molecular sieves can also be prepared by crystallizing a mixture of an oxide of silicon, an oxide of boron, an alkylammonium compound and ethylenediamine. This method is carried out in a manner such that the initial reactant molar ratios of water to silica range from about 5 to about 25, preferably about 10 to about 22, and most preferably about 10 to about 15. In addition, preferable molar ratios for initial reactant silica-to-oxide of boron range from about 4 to about 150, more preferably about 5 to about 80, and most preferably about 5 to about 20. The molar ratio of ethylenediamine to silicon oxide used in the preparation of AMS-1B crystalline borosilicate should be above about 0.05, typically below about 5, preferably about 0.1 to about 1.0, and most preferably about 0.2 to about 0.5. The molar ratio of alkylammonium template compound or precursor-to-silicon oxide useful in the instant preparation can range from 0 to about 1 or above, typically above about 0.001, preferably about 0.05 to about 0.1, and most preferably from about 0.005 to about 0.02. The silica source is preferably a low sodium content silica source containing less than 2,000 ppmw Na and most preferably less than 1,000 ppmw Na, such as Ludox AS-40 which contains 40 wt. % $SiO_2$ and 0.08 wt. % $Na_2O$ or Nalco 2327 which has similar specifications.

It is noted that the preferable amount of alkylammonium template compound used in the instant preparation method is substantially less than that required to produce AMS-1B conventionally using an alkali metal cation base. The borosilicate prepared by the instant method typically contains at least 9,000 ppmw boron and less than about 100 ppmw sodium and is designated as HAMS-1B-3.

The HAMS-1B-3 crystalline borosilicate has a higher boron content and a lower sodium content than crystalline borosilicates formed using conventional techniques.

In accordance with the present invention, the above-described shape selective molecular sieve component is dispersed in a matrix containing a nonmolecular sieve, porous refractory inorganic oxide matrix component comprising silica-alumina, wherein the alumina is present in the silica-alumina in an amount ranging from about 5 to about 50 wt. % alumina with the optimum amount ranging from about 10 to about 30 wt. % alumina based on the total amount of silica-alumina present. The subject matrix can also include other matrix components such as alumina, silica, zirconia, titania, etc., and various combinations thereof. The matrix component also can contain various adjuvants such as phosphorus oxides, boron oxides and/or halogens such as fluorine or chlorine. Usefully, the molecular sieve-matrix dispersion contains about 5 to about 70 wt. % zeolite component and about 30 to about 95 wt. % matrix component.

While not wishing to be bound by the following theory, it is believed that the silica-alumina present in the dewaxing catalyst provides nonselective hydrocracking activity which effects the hydrocracking of low VI naphthenes.

Methods for dispersing molecular sieve materials within a matrix component are well known to persons skilled in the art and applicable with respect to the shape selective molecular sieve materials employed according to the present invention. A preferred method is to blend the shape selective molecular sieve component, preferably in finely-divided form, in a sol, hydrosol or hydrogel of an inorganic oxide, and then add a gelling medium such as ammonium hydroxide to the blend with stirring to produce a gel. The resulting gel can be dried, shaped if desired, and calcined. Drying preferably is conducted in air at a temperature of about 80° to about 350° F. (about 27 to about 177° C.) for a period of several seconds to several hours. Calcination preferably is conducted by heating in air at about 800° to about 1,200° F. (about 427 to about 649° C.) for a period of time ranging from about ½ to about 16 hours.

Another suitable method for preparing a dispersion of shape selective molecular sieve component in a porous refractory oxide matrix component is to dry blend particles of each, preferably in finely-divided form, and then shape the dispersion if desired.

Relative proportions of the shape selective molecular sieve component and hydrogenating components of the catalysts are such that at least a catalytically effective amount of each is present. Preferably, catalysts employed according to the invention contain about 10 to about 70 wt. % based on total catalyst weight of the molecular sieve component and about .1 to about 20 wt. % of the hydrogenating component. More preferably, molecular sieve component concentration ranges from about 30 to about 50 wt. % in order to attain a desirable degree of selective cracking activity while avoiding inclusion in the catalyst of amounts of molecular sieve component that unduly increase the cost of the ultimate catalyst. When the molecular sieve component is employed as a dispersion in a matrix component, preferred matrix component content ranges from about 20 to about 70 wt. % based on total catalyst weight.

The hydrogenation component of the catalyst employed according to the present invention comprises a metal selected from the group consisting of Group VIB metals and Group VIII metals. The metal components can be present in elemental form, as oxides or sulfides, or as combinations thereof. Useful Group VIII metals include iron, cobalt, nickel, ruthenium, rhodium, palladium, osmium, iridium and platinum. Among these, palladium and platinum are most preferred owing to their superior hydrogenating activities. Content of the Group VIB metal component, calculated as hexavalent metal oxide, preferably ranges from about 1 to about 20 wt. % with about 7 to about 18 wt. % being more preferred from the standpoint of hydrogenating activity based on total catalyst weight. Group VIII metal content, calculated as divalent metal oxide in the case of cobalt, nickel and/or iron, preferably ranges from about 0.1 to about 10 wt. % with about 0.5 to about 5 wt. % being more preferred in terms of hydrogenation activity. Higher levels of metals can be employed if desired though the degree of improvement resulting therefrom typically is insufficient to justify the added cost of the metals.

The hydrogenating component of the catalyst employed according to this invention can be associated with the shape selective molecular sieve cracking component by impregnation of the molecular sieve component, or molecular sieve component dispersed in a porous refractory inorganic oxide matrix, with one or more solutions of compounds of the metals of the hydrogenating component which compounds are convertible to oxides on calcination. It also is contemplated, however, to impregnate a porous refractory inorganic oxide matrix component with such solutions of the metal components and then blend the molecular sieve component with the resulting impregnation product. Accordingly, the present invention contemplates the use of catalysts in which hydrogenating component is deposed on the molecular sieve component or on a molecular sieve-matrix component dispersion or on the matrix component of a molecular sieve-matrix dispersion.

The mechanics of impregnating the molecular sieve component, matrix component or molecular sieve matrix composite with solutions of compounds convertible to metal oxides on calcination are well known to persons skilled in the art and generally involve forming solutions of appropriate compounds in suitable solvents, preferably water, and then contacting the molecular sieve matrix component or molecular sieve matrix dispersion with an amount or amounts of solution or solutions sufficient to deposit appropriate amounts of metal or metal salts onto the molecular sieve or molecular sieve-matrix dispersion. Useful metal compounds convertible to oxides are well known to persons skilled in the art and include various ammonium salts, as well as metal acetates, nitrates, anhydrides, etc.

The original cation associated with the molecular sieve, i.e., the alkali metal cations, ammonium cations, or hydrogen cations, can be replaced at least in part by ion exchange with hydrogenation metal component-containing ions by techniques which are known in the art. Ion exchange techniques known in the art are disclosed in many patents including U.S. Pat. Nos. 3,140,249, 3,140,250, and 3,140,253, the teachings of which are incorporated by reference into this specification.

The above-described catalysts can be employed in any suitable form such as spheres, extrudate, pellets, C-shaped or cloverleaf-shaped particles.

The dewaxing process is suitably operated at the conditions set out below in Table 2.

TABLE 2

DEWAXING OPERATING CONDITIONS

| Conditions | Broad Range | Preferred Range |
|---|---|---|
| Temperature, °F. | 500–900 | 500–750 |
| Total pressure, psig | 100–3,000 | 300–900 |
| LHSV | 0.1–20 | 0.2–5 |
| Hydrogen rate, SCFB | 500–20,000 | 2,000–5,000 |
| Hydrogen partial pressure, psig | 50–2,500 | 300–800 |

As noted above, the preferred dewaxing catalyst is one where the molecular sieve component is a crystalline borosilicate component of the AMS-1B type in hydrogen form where the hydrogenation component is palladium.

Products obtained according to this aspect of the invention exhibit low pour points, high viscosity index and good stability. Preferably, pour point ranges from about −30 to about +20 and viscosity index ranges from about 70 to about 95.

The present invention is described in further detail in connection with the following example, it being understood that the same is for purposes of illustration and not limitation.

EXAMPLE

The present example demonstrates the superiority of the present invention incorporating a silica-alumina matrix with the dewaxing catalyst over a process wherein the dewaxing catalyst contains an alumina matrix.

An SAE 40 distillate was hydrotreated over a commercially available Shell 424 catalyst containing both nickel and molybdenum. The hydrotreating step was carried out at conditions which included a pressure of 1600 psig, temperature of 725° F., a liquid hourly space velocity of 0.50 volumes oil per volume catalyst per hour and a hydrogen rate of 2,500 standard cubic feet per barrel.

The hydrotreater influent and the hydrotreater effluent possessed the following compositions as set out in Table 3.

TABLE 3

| | Hydrotreater Influent | Hydrotreater Effluent |
|---|---|---|
| Sulfur | 0.70 wt. % | 1.7 ppm |
| Basic Nitrogen, ppm | 86 | <5 |
| Total Nitrogen, ppm | 516 | 0.4 |
| Carbon, wt. % | 86.58 | 86.53 |
| Hydrogen, wt. % | 12.56 | 13.46 |
| Pour Point °F. | 120 | 120 |

TABLE 3-continued

| | Hydrotreater Influent | Hydrotreater Effluent |
|---|---|---|
| 100° C. Viscosity CS+ | 18.22 | 18.22 |

The effluent from the hydrotreating zone was then treated with a dewaxing catalyst in accordance with the present invention wherein the matrix contained 74.5 wt. % silica and 25 wt. % alumina in the form of silica-alumina. Further details of the silica-alumina matrix incorporated with the dewaxing catalyst are set out below in Table 4.

TABLE 4

| | |
|---|---|
| CHEMICAL | |
| (wt. %, Dry Bases$^{1750°\ F.}$) | |
| Total Volatile$^{1750°\ F.}$ | 2.5 |
| Silica, $SiO_2$ | 74.5 |
| Alumina, $Al_2O_3$ | 25.0 |
| Sodium, $Na_2O$ | 0.05 |
| Sulfate, $SO_4$ | 0.30 |
| Iron, FE | 0.03 |
| Calcium, CaO | 0.05 |
| Chlorine, Cl | .01 |
| PHYSICAL | |
| Surface Area, $M^2$/gm | 325 |
| Pore volume, cc/gm | 0.45 |
| Packed Density, gm/cc | 0.73 |
| Avg. Crush Strength, lbs. | 15(3/16") |

The dewaxing catalyst further contained 0.5 wt. % palladium, based on total catalyst weight, The non-palladium components in the dewaxing catalyst were present in amounts such that there were 40 wt. % HAMS-1B-3 crystalline borosilicate and 60 wt. % silica-alumina.

The catalyst was prepared by dry blending the silica-alumina powder with the crystalline borosilicate sieve component. The so-formed blend was then extruded in a conventional manner, followed by impregnation of the palladium component in a conventional manner.

The results of this run are set out below in Table 5.

TABLE 5

| | | | | |
|---|---|---|---|---|
| Time on stream, hrs | 70 | 84 | 112 | 138 |
| Avg. Cat. Temp., °F. | 600 | 600 | 601 | 625 |
| LHSV | 0.50 | 0.50 | 0.50 | 0.50 |
| $H_2$, SCFB | 5641 | 5312 | 5421 | 5064 |
| Pressure, psig | 800 | 800 | 800 | 800 |
| Yields, wt % | | | | |
| Methane | 0.02 | 0.01 | 0.00 | 0.00 |
| Ethane | 0.11 | 0.04 | 0.03 | 0.03 |
| Propane | 4.12 | 2.35 | 2.29 | 2.14 |
| Butane | 3.69 | 2.31 | 2.38 | 2.22 |
| $C_5$+ Naphtha | 14.15 | 12.25 | 15.21 | 11.58 |
| Distillate | 42.26 | 42.22 | 37.49 | 35.26 |
| Lube Oil | 36.49 | 41.48 | 44.48 | 49.51 |
| Total Liquid | 92.89 | 95.95 | 97.18 | 96.36 |
| Properties of Lube Oil | | | | |
| Pour pt, °F. | 0 | 10 | 40 | 25 |
| Viscosity, cSt$^{100°\ C.}$ | 16.31 | — | 15.50 | 15.98 |
| Viscosity, cSt$^{40°\ C.}$ | 197.06 | — | 173.28 | 169.33 |
| Viscosity index | 84 | — | 90 | 97 |
| Sulfur, wt % | — | — | — | — |
| Nitrogen, ppm | — | — | — | — |
| Time on stream, hrs | 208 | 258 | 276 | 300 |
| Avg. Cat. Temp., °F. | 650 | 650 | 650 | 650 |
| LHSV | 0.50 | 0.50 | 0.50 | 0.50 |
| $H_2$, SCFB | 4981 | 4654 | 4868 | 4558 |
| Pressure, psig | 800 | 800 | 800 | 800 |
| Yields, wt % | | | | |
| Methane | 0.01 | 0.01 | 0.01 | 0.01 |
| Ethane | 0.10 | 0.10 | 0.10 | 0.08 |

TABLE 5-continued

| | | | | |
|---|---|---|---|---|
| Propane | 3.74 | 3.50 | 3.66 | 2.64 |
| Butane | 3.00 | 2.80 | 2.93 | 2.13 |
| $C_5$+ Naphtha | 3.90 | 6.43 | 6.71 | 8.84 |
| Distillate | 32.79 | 41.54 | 32.64 | 26.81 |
| Lube Oil | 53.14 | 57.71 | 52.72 | 66.31 |
| Total Liquid | 89.84 | 105.68 | 92.07 | 101.96 |
| Properties of Lube Oil | | | | |
| Pour pt, °F. | — | −10 | 0 | 0 |
| Viscosity, cSt$^{100°\ C.}$ | — | 13.40 | 13.59 | 13.63 |
| Viscosity, cSt$^{40°\ C.}$ | — | 146.72 | 149.58 | 150.49 |
| Viscosity index | — | 83 | 83 | 83 |
| Sulfur, wt % | — | — | — | — |
| Nitrogen, ppm | — | — | — | — |

The comparative catalyst contained the same composition as the above-described invention catalyst except that the silica-alumina in the matrix was supplanted with pure alumina. This comparative catalyst was prepared in substantially the same manner as the invention catalyst.

The results of the comparative run carried out with dewaxing catalyst containing an alumina matrix are set out below in Table 6. The feedstock in the comparative run was the same hydrotreater effluent used in the run carried out in accordance with the invention.

TABLE 6

| | | | | | |
|---|---|---|---|---|---|
| Time on stream, hrs | 402 | 478 | 497 | 527 | 527 |
| Avg. Cat. Temp., °F. | 649 | 629 | 629 | 629 | 629 |
| LHSV | 0.50 | 0.50 | 0.50 | 0.50 | 0.50 |
| $H_2$, SCFB | 5197 | 5242 | 5406 | 5570 | 5335 |
| Pressure, psig | 800 | 800 | 800 | 800 | 800 |
| Yields, wt % | | | | | |
| Methane | 0.03 | 0.00 | 0.01 | 0.01 | 0.01 |
| Ethane | 0.15 | 0.03 | 0.03 | 0.03 | 0.03 |
| Propane | 3.96 | 1.73 | 1.86 | 1.91 | 2.04 |
| Butane | 3.11 | 1.66 | 2.00 | 2.06 | 2.21 |
| $C_5$+ Naphtha | 15.29 | 9.67 | 10.92 | 7.81 | 9.48 |
| Distillate | 32.75 | 28.94 | 30.87 | 30.62 | 30.55 |
| Lube Oil | 42.94 | 56.01 | 53.96 | 56.23 | 56.50 |
| Total Liquid | 90.99 | 94.66 | 95.75 | 94.66 | 96.53 |
| Properties of Lube Oil | | | | | |
| Pour pt, °F. | −30 | 20 | 5 | 10 | 5 |
| Viscosity, cSt$^{100°\ C.}$ | 15.27 | 14.57 | 14.92 | 14.87 | 14.88 |
| Viscosity, cSt$^{40°\ C.}$ | 197.12 | 168.62 | 175.46 | 174.15 | 176.63 |
| Viscosity index | 71 | 82 | 81 | 82 | 80 |
| Sulfur, wt % | — | — | — | — | — |
| Nitrogen, ppm | 17 | 25 | 9.2 | — | 8 |
| Time on stream, hrs | 574 | 597 | 621 | 645 | |
| Avg. Cat. Temp., °F. | 639 | 641 | 641 | 637 | |
| LHSV | 0.50 | 0.50 | 0.50 | 0.50 | |
| $H_2$, SCFB | 5314 | 5248 | 5248 | 5283 | |
| Pressure, psig | 800 | 800 | 800 | 800 | |
| Yields, wt % | | | | | |
| Methane | 0.01 | 0.01 | 0.00 | 0.00 | |
| Ethane | 0.03 | 0.03 | 0.02 | 0.02 | |
| Propane | 2.03 | 2.00 | 0.82 | 0.82 | |
| Butane | 2.20 | 2.17 | 0.86 | 0.86 | |
| $C_5$+ Naphtha | — | 7.64 | 8.37 | 8.88 | |
| Distillate | 31.25 | 28.34 | 30.88 | 30.20 | |
| Lube Oil | 63.57 | 58.60 | 54.68 | 53.23 | |
| Total Liquid | 106.05 | 94.58 | 93.93 | 92.31 | |
| Properties of Lube Oil | | | | | |
| Pour pt, °F. | −5 | −5 | −15 | −30 | |
| Viscosity, cSt$^{100°\ C.}$ | 14.86 | 14.85 | 15.32 | 15.21 | |
| Viscosity, cSt$^{40°\ C.}$ | 178.70 | 180.30 | 188.30 | 187.79 | |
| Viscosity index | 78 | 77 | 78 | 77 | |
| Sulfur, wt % | — | — | — | — | |
| Nitrogen, ppm | — | — | — | 5.2 | |

FIG. 1 shows the unexpected improvement in VI afforded by the process of the invention as contrasted with the use of the comparative all-alumina matrix catalyst. Specifically, VI is plotted as a function of pour point for both the invention run and the comparative run. It is speculated that this improvement in VI is effected by the nonselective hydrocracking activity provided by the silica-alumina which hydrocracks naphthenes possessing a low VI.

What is claimed is:

1. A process for reducing the pour point of a hydrocarbon feedstock containing nitrogen and sulfur-containing compounds which process comprises:

passing the hydrocarbon feedstock to a hydrotreating zone wherein hydrogen is contacted with the hydrocarbon feedstock in the presence of a hydrotreating catalyst at hydrotreating conditions wherein a substantial portion of the nitrogen and sulfur-containing compounds are converted to hydrogen sulfide and ammonia to form a hydrotreating zone effluent;

passing at least a portion of the effluent from the hydrotreating zone to a stripping zone wherein hydrogen sulfide and ammonia are removed from the hydrotreating zone effluent to form a stripping zone effluent;

passing at least a portion of the stripping zone effluent containing less than about 10 ppmw nitrogen-containing compounds based on nitrogen and less than about 20 ppmw sulfur-containing compounds based on sulfur to a dewaxing zone wherein hydrogen is contacted with the said stripping zone effluent at catalytic dewaxing conditions in the presence of a catalyst composition comprising a borosilicate molecular sieve dispersed within a porous refractory inorganic oxide matrix comprising silica-alumina wherein alumina is present in the silica-alumina in an amount ranging from about 5 to about 50 wt. % based on the total amount of silica-alumina present, and at least one hydrogenation component selected from the group consisting of Group VIB and Group VIII metals.

2. The process of claim 1 wherein the alumina is present in the silica-alumina in an amount ranging from about 10 to about 30 wt. %.

3. The process of claim 1 wherein the hydrogenation component is a Group VIII noble metal comprising platinum.

4. The process of claim 1 wherein the hydrogenation component is a Group VIII noble metal comprising palladium.

5. The process of claim 1 wherein the hydrogenation component is deposed on the borosilicate-matrix dispersion.

6. The process of claim 1 wherein the hydrogenation component is deposed on the matrix component of the borosilicate-matrix dispersion.

7. The process of claim 1 wherein borosilicate molecular sieve comprises an AMS-1B crystalline borosilicate molecular sieve.

8. The process of claim 1 wherein the borosilicate molecular sieve contains less than about 100 ppmw sodium.

9. The process of claim 1 wherein crystalline borosilicate molecular sieve is prepared by reacting under crystallization conditions, in the substantial absence of a metal or ammonium hydroxide, an aqueous mixture containing an oxide-of silicon, an oxide of boron, and ethylenediamine, wherein the molar ratio of ethylenediamine to silica is of above about 0.05.

10. The process of claim 1 wherein the crystalline borosilicate molecular sieve is prepared by reacting under crystallization conditions, in the substantial absence of a metal or ammonium hydroxide, an aqueous mixture containing an oxide of silicon, an oxide of boron, and ethylenediamine, wherein the molar ratio of ethylenediamine to silica is of above about 0.05, wherein the crystalline borosilicate molecular sieve contains at least about 9,000 ppmw boron.

11. The process of claim 9 wherein the aqueous mixture further contains an alkylammonium cation or precursor of an alkylammonium cation.

12. The process of claim 10 wherein the aqueous mixture further contains an alkylammonium cation or precursor of an alkylammonium cation.

13. The process of claim 1 wherein the hydrocarbon feedstock is a waxy lube of distillate.

14. A process for reducing the pour point of a hydrocarbon feedstock containing nitrogen and sulfur-containing compounds which comprises:

passing the hydrocarbon feedstock to a solvent extraction zone wherein the hydrocarbon feedstock is extracted with a solvent to remove a portion of the aromatic compounds contained in the hydrocarbon and thereby form an extraction zone raffinate;

passing at least a portion of the extraction zone raffinate to a hydrotreating zone wherein hydrogen is contacted with hydrocarbon feedstock in the presence of a hydrotreating catalyst at hydrotreating conditions wherein a substantial portion of the nitrogen and sulfur-containing compounds are converted to hydrogen sulfide and ammonia to form a hydrotreating zone effluent;

passing at least a portion of the effluent from the hydrotreating zone to a stripping zone wherein hydrogen sulfide and ammonia are removed from the hydrotreating zone effluent to form a stripping zone effluent;

passing at least a portion of the stripping zone effluent to a dewaxing zone wherein hydrogen is contacted with the stripping zone effluent at catalytic dewaxing conditions in the presence of a catalyst composition comprising a borosilicate molecular sieve dispersed within a porous refractory inorganic oxide matrix comprising silica-alumina wherein alumina is present in the silica-alumina in an amount ranging from about 5 to about 50 wt. % based on the total amount of silica-alumina present, and at least one hydrogenation component selected from the group consisting of Group VIB and Group VIII metals.

15. The process of claim 14 wherein the hydrogenation component is a Group VIII noble metal comprising platinum.

16. The process of claim 14 wherein the hydrogenation component is a Group VIII noble metal comprising palladium.

17. The process of claim 14 wherein the hydrogenation component is deposed on the borosilicate-matrix dispersions.

18. The process of claim 14 wherein the hydrogenation component is deposed on the matrix component of the borosilicate-matrix dispersion.

19. The process of claim 14 wherein the borosilicate molecular sieve comprises an AMS-1B crystalline borosilicate molecular sieve.

20. The process of claim 14 wherein the crystalline borosilicate molecular sieve is prepared by reacting under crystallization conditions, in the substantial absence of a metal or ammonium hydroxide, an aqueous mixture containing an oxide of silicon, an oxide of boron, and ethylenediamine, wherein the molar ratio of ethylenediamine to silica is of above about 0.05.

21. The process of claim 14 wherein the crystalline borosilicate molecular sieve is prepared by reacting under crystallization conditions, in the substantial absence of a metal or ammonium hydroxide, an aqueous mixture containing an oxide of silicon, an oxide of boron, and ethylenediamine, wherein the molar ratio of ethylenediamine to silica is of above about 0.05, wherein the borosilicate molecular sieve contains at least about 9,000 ppmw boron.

22. The process of claim 20 wherein the aqueous mixture further contains an alkylammonium cation or precursor of an alkylammonium cation.

23. The process of claim 21 wherein the aqueous mixture further contains an alkylammonium cation or precursor of an alkylammonium cation.

24. The process of claim 14 wherein the borosilicate molecular sieve contains less than about 100 ppm sodium.

25. The process of claim 14 wherein the alumina is present in the silica-alumina in an amount ranging from about 10 to about 30 wt. %.

* * * * *